US006497631B1

(12) United States Patent
Fritzke et al.

(10) Patent No.: US 6,497,631 B1
(45) Date of Patent: Dec. 24, 2002

(54) BALL BAT

(75) Inventors: Mark A. Fritzke, Portland, OR (US); Michael D. Eggiman, Hillsboro, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/396,700

(22) Filed: Sep. 15, 1999

(51) Int. Cl.[7] ..... A63B 59/06
(52) U.S. Cl. ..... 473/566; 473/567
(58) Field of Search ..... 473/566, 567

(56) References Cited

U.S. PATENT DOCUMENTS

| | | | | |
|---|---|---|---|---|
| 3,876,204 | A | | 4/1975 | Moore et al. |
| 3,963,239 | A | | 6/1976 | Fujii |
| 4,014,542 | A | | 3/1977 | Tanikawa |
| 4,047,731 | A | | 9/1977 | VanAuken |
| 4,082,277 | A | | 4/1978 | Van Auken et al. |
| 4,116,252 | A | | 9/1978 | Ikeda |
| 4,348,247 | A | | 9/1982 | Loyd et al. |
| 4,505,479 | A | | 3/1985 | Souders |
| 4,569,521 | A | | 2/1986 | Mueller |
| 4,848,745 | A | | 7/1989 | Bohannan et al. |
| 4,933,040 | A | | 6/1990 | Wesley, Jr. |
| 5,104,123 | A | | 4/1992 | Okitsu et al. |
| 5,114,144 | A | | 5/1992 | Baum |
| 5,131,651 | A | | 7/1992 | You |
| 5,364,095 | A | | 11/1994 | Easton et al. |
| 5,409,214 | A | | 4/1995 | Cook |
| 5,415,398 | A | | 5/1995 | Eggiman |
| 5,458,330 | A | | 10/1995 | Baum |
| 5,460,369 | A | | 10/1995 | Baum |
| 5,511,777 | A | | 4/1996 | McNeely |
| 5,533,723 | A | | 7/1996 | Baum |
| 5,624,115 | A | | 4/1997 | Baum |
| 5,676,610 | A | * | 10/1997 | Bhatt et al. ..... 473/566 |
| 5,722,908 | A | | 3/1998 | Feeney et al. |
| 5,800,293 | A | | 9/1998 | MacKay, Jr. |
| 5,899,823 | A | | 5/1999 | Eggiman |
| 5,954,602 | A | | 9/1999 | Eggiman et al. |
| 6,042,493 | A | * | 3/2000 | Chauvin et al. ..... 473/566 |

FOREIGN PATENT DOCUMENTS

| | | |
|---|---|---|
| AU | 23580/97 | 12/1997 |
| GB | 2053696 | 2/1981 |
| JP | 51-13165 | 4/1976 |
| JP | 4-303477 | 10/1992 |
| JP | 5-23407 | 2/1993 |

* cited by examiner

*Primary Examiner*—Mark S. Graham

(57) ABSTRACT

A bat includes a handle portion, tubular impact portion and tubular insert mounted co-axially within the impact portion. A thin tubular composite member is bonded either to the inner or outer surface of the insert. Alternatively the composite member-reinforced insert may be mounted co-axially around the outer surface of the impact portion. In other embodiments, the composite member may be bonded directly to either the inner or outer surface of the impact portion.

35 Claims, 3 Drawing Sheets

BALL BAT

FIELD OF THE INVENTION

The present invention relates to softball and baseball bats and more particularly relates to bats formed at least in part from a composite material(s).

BACKGROUND OF THE INVENTION

Recent years have seen an emergence of new and improved tubular metallic softball and baseball bats. The most common tubular bat is the aluminum single-wall tubular bat. Such bats have the advantage of a generally good impact response, meaning that the bat effectively transfers power to a batted ball. This effective power transfer results in ball players achieving good "slugging" distances with batted balls. An additional advantage of such aluminum bats is the improved durability over crack-prone wooden bats.

Despite the advantages of tubular aluminum bats, there is an ongoing effort to improve the performance and durability of the conventional design. Generally speaking, bat performance is a function of the weight of the bat, the size of the hitting area or "sweet spot" of the bat, and the impact response of the bat. The durability of a bat relates, at least in part, to its ability to resist denting and depends on strength and stiffness of the tubular frame. While recent innovations in bat technology have increased performance and durability, most new bat designs typically improve performance or durability at the expense of the other because of competing design factors. For example, an attempt to increase the durability of the bat often produces an adverse effect on the bat's performance.

More specifically, the impact response of a bat depends on the bat wall's elasticity, rebound recovery time, and rebounding force. Generally, impact response is optimized when the bat undergoes maximum elastic deflection and then rebounds with the greatest force in the shortest amount of time. The elasticity of a bat can be increased by reducing the thickness of the bat's tubular frame. In contrast, the durability of a bat generally is improved by increasing the thickness of the tubular frame. Consequently, a bat having a relatively thin tubular wall is capable of large elastic deflection, but may be vulnerable to undesirable local plastic deformation (or "denting"). On the other hand, a relatively thick tubular wall is more durable but may be too stiff to achieve optimum slugging performance. Thus, enhancing one design aspect of a bat often compromises another.

Another example of competing design factors concerns the bat's optimum hitting area or "sweet spot." The sweet spot is typically located near the center of the impact area of the bat. The performance of the bat drops off considerably when a ball impacts the bat outside the sweet spot, for example, near the end of the bat. When this occurs, the batter feels greater vibrations and transfers less energy from the bat to the ball. An obvious way to increase the sweet spot of a bat is to increase the length and circumference of the bat. This option is constrained by institutional rules and regulations. In addition, an increase in the overall size of the bat undesirably adds weight, often causing reduced bat speed and less slugging distance. (A hitter often can increase bat speed by using a lighter bat, thereby increasing the force transferred to the ball upon impact.

An example of a bat incorporating a composite insert is shown in U.S. Pat. No. 5,364,095. This patent discloses a tubular aluminum bat having a carbon composite insert to increase the "stiffness" of the metal tube. The insert is made of multiple fiber layers, each layer having bidirectional woven fibers directed at 0 and 90 degrees relative to the axis of the bat. The insert is bonded to the barrel portion of the surrounding metal tube or frame and presses outwardly on the frame to produce a pre-load stress of several thousand pounds per square inch. The insert appears to be formed from multiple layers of glass and carbon fiber material (thickness of 0.03 to 0.05 inch) so as to be a self-supporting structure capable of withstanding several thousand pounds of compressive stress. This design gives the bat a relatively stiff, rigid tubular frame which appears to be capable of limited elastic deformation, a less than ideal trait if the goal is to optimize slugging performance. (One would expect this design to behave like a single-wall bat in which the compressive stress must be overcome before the wall begins to deflect.)

While composite materials offer the advantage of a high strength to weight ratio, such materials also present design challenges. Composite inserts and bat frames are prone to wear and tear due to the inter-laminar shear which can occur between bonded layers of composite material. The deflection caused when a ball impacts the bat produces shearing stresses between the composite layers, sometimes causing the bond between adjacent layers to fracture or separate (especially over time). When this occurs, the bat's performance deteriorates. This is particularly disadvantageous when one considers the relatively high cost of manufacturing composite inserts.

Thus, despite the advantages offered by composite materials, there are two constraints associated with using such materials: a reduced elastic deflection potential which compromises bat performance and a tendency of the composite layers to separate over time due to inter-laminar shear.

As a result, there is a need for a tubular bat that offers at least some of the advantages of composite materials without the constraints. There is a need for a tubular bat that provides excellent slugging performance and improved durability. There also is a need for a multi-wall bat which has a relatively thin barrel wall and yet exhibits excellent durability. Further, there is a need for a single wall bat having the excellent durability characteristic of most single wall bats as well as improved slugging performance.

BRIEF SUMMARY OF THE INVENTION

The present invention provides an improved baseball or softball bat with superior durability characteristics and little or no reduction in bat performance. The invention does so by providing a relatively thin, light (but strong) composite material, with directional strength characteristics to resist dent-causing forces, in bonded relationship to a metal carrier. For example, the present invention includes a single- or multi-wall tubular bat having at least one composite layer, with its greatest strength in a substantially circumferential direction, bonded directly to a tubular member which deflects upon ball impact.

In one embodiment, the bat has a tubular frame and a tubular insert reinforced with at least one composite layer. The composite layer has its greatest strength in a substantially circumferential direction and is bonded to at least a portion of the outer surface of the insert. The composite layer provides several advantages, including improved durability with little or no reduction in performance. Because the composite layer adds strength and stiffness to the insert in the circumferential direction, it helps prevent local plastic deformation caused by circumferential stresses while allowing the frame and insert to deflect sufficiently in the axial direction to transfer substantial energy back to the ball as it leaves the surface of the bat. In another embodiment, the composite layer(s) is bonded to at least a portion of the inner surface of the insert.

The present invention also contemplates the use of multiple composite layers of varying lengths and different strength characteristics bonded to the impact portion and/or the insert of a bat so that a manufacturer can add strength and stiffness to a bat where it is needed and in the direction that it is needed. Because the intended use of a bat often drives its design, the various attributes of the composite layers, such as length, thickness, location on a bat, or orientation of fibers, may be selected to suit a particular application.

Another embodiment, which exhibits excellent durability and performance characteristics for hitting a softball, has two composite layers bonded to the outer surface of a tubular sleeve. A longer, first composite layer having its fibers oriented substantially at 0 degrees relative to the axis of the bat is applied directly to the outer surface of the sleeve. A shorter, second composite layer having its fibers oriented substantially at 90 degrees relative to the axis of the bat is placed on top of the first layer, with the second layer being positioned closer to the "sweet spot."

Various advantages and features of novelty which characterize the invention are particularized in the claims forming a part hereof. However, for a better understanding of the invention and its reference should be had to the drawings and to the accompanying description in which there is illustrated and described preferred embodiments of the invention.

DETAILED DESCRIPTION OF THE PREFERRED EMBODIMENTS

Figure 1:
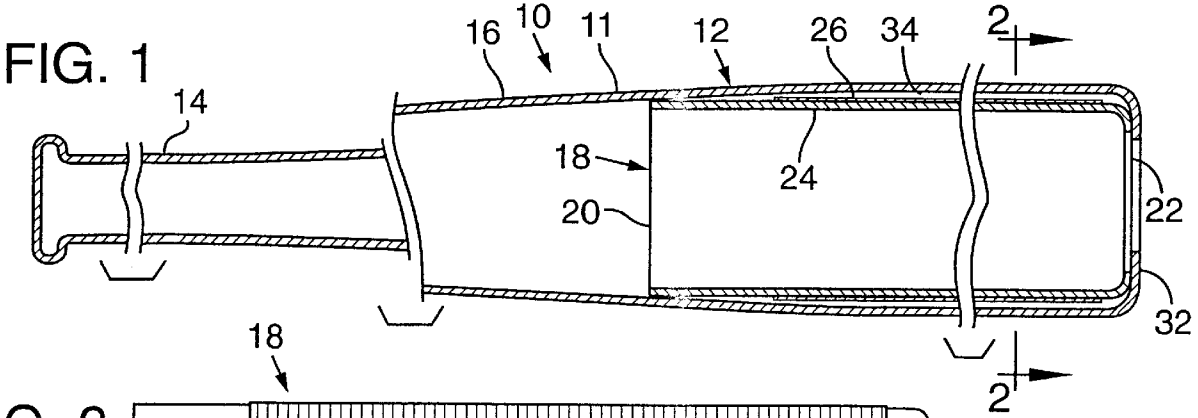
FIG. 1 is a sectional view of a bat in accordance with the present invention, which includes an insert and a composite layer on the outer surface of the insert.

Referring to FIG. 1, a tubular bat 10, according to one embodiment of the present invention, has a tubular frame 11 with a relatively large constant-diameter impact portion 12, a relatively small diameter handle portion 14, and an intermediate tapered portion 16 that extends between the handle and impact portions. The impact portion 12 is "tubular" or "substantially tubular," terms intended to encompass softball style bats having a substantially cylindrical impact portion (or "barrel") as well as baseball style bats having a substantially conical (or "frustum-like") barrel.

The tubular frame 11 engages a tubular insert 18 within the impact portion 12. The bat 10 provides two essentially parallel walls in the "hitting zone" or barrel region. The insert 18 is restrained within the tubular frame 11 either by retaining the ends of the insert in place or at least trapping the insert within the barrel to permit some axial movement. As shown in FIG. 1, for example, a first end 20 of the insert 18 contacts the intermediate tapering portion 16 of the tubular frame 11, and a second end 22 of the insert 18 contacts an end portion 32 of the tubular frame 11. However, it will be appreciated that the ends of the insert can be supported or fixedly coupled to the frame in other ways. For example, the second end 22 of the insert 18 can be held in place by an end plug (not shown) which forms a closure for the tubular frame 11 at the end portion 32. Alternatively, the insert 18 may be end-supported within the tubular frame 11 in other ways, such as by fasteners or an adhesive. The insert 18 also may be compressively restrained at its ends by the impact portion 12. While it may be somewhat advantageous to substantially pin or lock the insert ends in place to limit axial movement relative to the impact portion, the present invention also provides benefits even if the insert is not locked in place and is free to move axially to some extent relative to the impact portion.

A gap 34 preferably exists between the impact portion 12 and the insert 18. The gap 34 allows the impact portion 12 to undergo some elastic deflection before contacting the insert 18. The size of the gap 34 will vary depending on the size and type of bat. In some applications, the gap is very small or nonexistent (i.e., zero clearance). The spatial relationship between the insert and impact portion 12 only needs to be sufficient to allow the insert and impact portion to move substantially independent of one another upon impact. This independent movement allows the insert to act much like a leaf spring upon impact. The presence of grease or other lubricant in the gap or, if there is no gap, at the interface between the insert and impact portion, facilitates such independent movement. In applications where a larger gap 34 is present, it is often advantageous for the impact portion 12 of the tubular frame 11 to be more elastic so that the frame will deflect across the gap 34 to transfer a sufficient portion of the impact load to the insert 18.

In those applications where a gap is provided between the insert and impact portion, the gap may be filled with a urethane, rubber or other elastic filler material. Even if the filler material is glued to the insert and impact portion, the pliable nature of the filler material still would permit significant relative independent movement between the insert and impact portion in the axial direction (again, much like a leaf spring). (This relationship is to be contrasted with the dynamics of these components in the radial direction, which is interdependent due to the load transfer dynamics between the insert and impact portion.)

The foregoing construction and relationship between the impact portion and insert is discussed in part in U.S. Pat. No. 5,415,398, the disclosure of which is incorporated by reference. In sum, the present invention works best in a multi-wall context when the insert wall is free to move substantially independent of the impact portion 12 in the axial direction and is not bonded or otherwise fixedly coupled to the impact portion by friction fit, adhesion or otherwise. In other words, the impact portion and insert do not behave like an integrated single-wall structure.

It will be apparent from the foregoing discussion that the principles of the present invention also apply if the insert is mounted in overlying coaxial relationship with the barrel, in which case the insert (or more accurately "exert") assumes the role of the "impact portion" to engage the ball and the impact portion assumes the role of the "insert."

Figure 2:
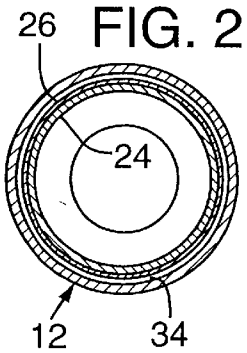
FIG. 2 is a sectional view taken along line 2—2 of FIG. 1.

Referring now to FIG. 2, the insert 18 comprises a metallic tubular sleeve 24 and a relatively thin composite layer 26 having its greatest strength in a substantially circumferential direction. The composite layer is bonded to the outer surface of the tubular sleeve 24. Preferably, the tubular sleeve 24 is made of the same material as the tubular frame 11. However, it is not critical to use the same materials for both components. A popular material for the bat and the sleeve is high-grade aluminum such as C405 or C555. It should be understood that other materials will suffice. For instance, at a higher cost, titanium or metal matrix composites (such as aluminum matrix composites) can be used for the tubular frame 11 and tubular sleeve 24.

The tubular sleeve 24, is essentially isotropic with respect to its ability to withstand applied stresses. In other words, the strength of tubular sleeve 24 is essentially equal in the circumferential and axial directions. When a bat strikes a ball, most of the stress created by the impact is distributed in the circumferential direction (sometimes referred to as hoop stress). It is believed that localized dents or dimples in the impact portion's outer surface, which have a deleterious effect on durability, are due to the circumferential stress component of forces generated by t he ball's impact with t he bat. Therefore, a composite layer 26 having its greatest strength in a substantially circumferential direction provides strength and stiffness to the tubular sleeve 24 in the direction that it is most needed to resist denting.

The composite layer 26 includes structural material to provide structural stability, and matrix material to support the structural material. In a preferred embodiment, the structural material is a series of fibers that are supported within the matrix material. In order for the composite layer 26 to have its greatest strength in a substantially circumferential direction, the fibers must extend in a direction greater than 45 degrees, that is, at an angle closer to 90 degrees than 0 degrees, in the circumferential direction. Most preferably, the fibers are oriented substantially at a ninety degree angle relative to the longitudinal center axis of the tubular frame 11. For example, the fibers may be oriented at about 80 to 90 degrees relative to the axis of the tubular frame. The composite layer 26 preferably has a thickness of within the range of about 0.003 to 0.015 inch (about 0.0055 inch for example, at least for some applications). More important than the thickness of any particular composite layer is the thickness of the composite material overall, which preferably falls within a range less than about 0.015 inch, most preferably about 0.003 to 0.015 inch. For example, a desirable thickness of say 0.006 inch can be achieved by a single layer of composite material having a thickness of 0.006 inch or two layers having a thickness of 0.003 inch each.

The composite layer 26 preferably consists of structural materials that are strong, stiff, and durable. In a preferred embodiment, the composite layer 26 includes carbon fibers commercially available in carbon fiber composite sheets. However, the fibers could be some other type of fiber material such as Kevlar™, or fiberglass.

The matrix of the composite layer 26 preferably is sufficiently durable and has sufficient adhesion properties to continue supporting the structural material even after repeated impacts. In a preferred embodiment, the matrix material is a toughened epoxy. Alternatively, the matrix can be some other thermally setting resin, such as a polyester or vinyl ester, or a thermoplastic resin.

An exemplary construction of the bat has the tubular frame 11 swaged from a constant-diameter aluminum tube to yield an integral, weld-free frame. Such swaging results in a tubular frame with thinner walls at the impact portion 12 and thicker walls at the handle portion 14. While swaging is used to produce the tubular frame 11 of the illustrated embodiment, it should be understood that other conventional methods of manufacturing the tubular frame may be used.

The sleeve 24 preferably is heat treated (in a manner conventional for aluminum alloys) and treated to apply a yellow chromate surface coating, using for example military specification MIL-C-5541. The coating provides the sleeve with a prepared surface which facilitates adhesion of the composite layer 26. A sheet of preimpregnated composite material ("prepreg") is then wrapped around the outer surface of the sleeve. To avoid an open seam between the two edges of the composite layer, the composite layer is wrapped around the sleeve such that the trailing edge of the composite layer slightly overlaps the leading edge. During the heat curing of the prepreg composite, the material bonds to the tube.

As one illustrated example, the tubular frame 11 has a yield strength of about 85,000 psi and the impact portion 12 is about 13 inches long with a wall thickness of 0.050 inch. The tubular sleeve 24 is about 13.25 inches long with a wall thickness of 0.054 inch. The composite layer 26 is about 8.5 inches long and about 0.055 inch thick, the fibers oriented at substantially 90 degrees to the longitudinal axis. The composite layer is positioned on the tubular sleeve such that a first end 28 of the composite layer is 4.00 inches from the first end 20 of the insert 18 and a second end 30 of the composite layer 26 is 0.75 inch from the second end 22 of the insert 18. The outer diameter of the insert 18 is such that a gap 34 (FIG. 1) of about 0.0045 inch exists between the outer surface of the insert and the inner surface of the impact portion 12 of the tubular frame 11.

While such dimensions yield excellent results, it is to be understood that they are exemplary only, and that many permutations of the bat frame, insert, and gap dimensions will work equally well. All permutations fall within the scope of the present invention.

The composite layer reinforces the sleeve 24, giving the insert greater hoop (circumferential) stiffness and strength in the impact portion (barrel) of the bat. The impact portion receives greater circumferential support, making it less prone to local plastic deformation (or "denting") and hence more durable. At the same time, the composite layer adds very little weight to the bat. It will be appreciated that a relatively thin composite material is preferred, typically one to three layers of composite material, since larger inter-laminar shear problems are more likely to occur as the thickness of the layered composite material increases. It also will be appreciated that the composite layer(s) can be relatively thin because they do not form a structure; the layer(s) is (are) carried by the metal sleeve which itself is a self-supporting structure.

Figure 3:
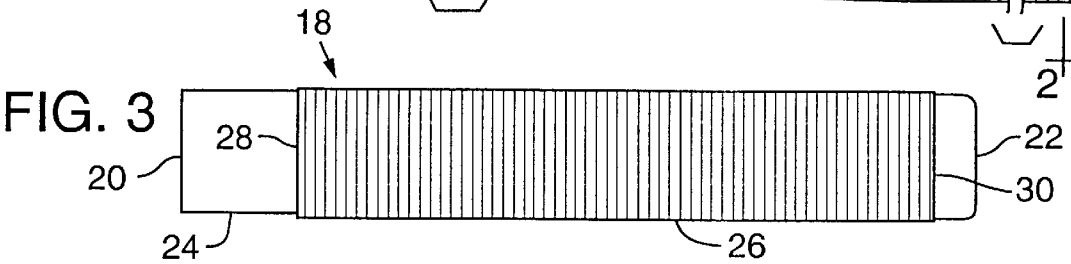
FIG. 3 is an enlarged view of the insert of FIGS. 1 and 2.
Figure 4:
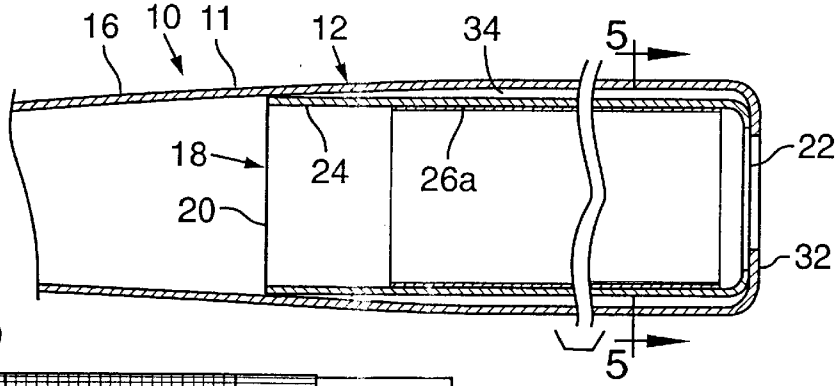
FIG. 4 is a sectional view of a second embodiment having an insert and a composite layer on the inner surface of the insert.
Figure 5:
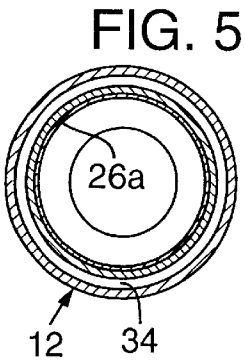
FIG. 5 is a sectional view taken along line 5—5 of FIG. 4.

In another embodiment of the present invention, as shown in FIGS. 4 and 5, a composite layer 26*a* is bonded to at least a portion of the inner surface of the insert 18 (instead of the outer surface). Although this embodiment is believed to perform as well as the embodiment of FIGS. 1–3, it is slightly less preferred from a manufacturing standpoint. It is easier and less expensive to wrap the composite layer 26 on the outer surface of the insert 18. More specifically, the composite wrap is inserted into the insert in a low tack condition. A bladder device also is inserted and inflated at low pressure (less than 1,000 psi) to assure contact between the composite and inner wall of the insert. The composite is then cured under pressure per standard composite processing methods.

Figure 6:
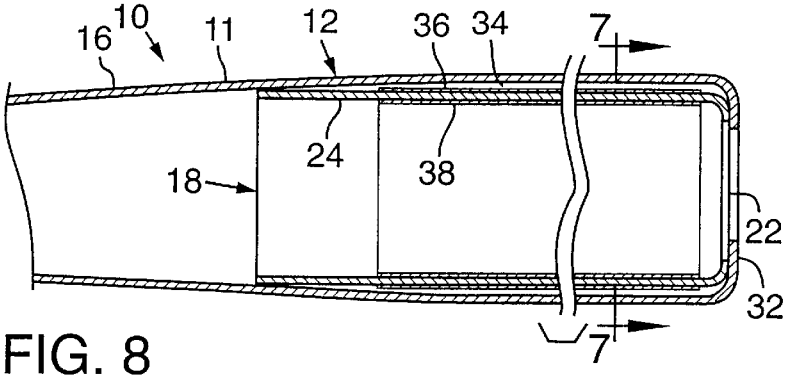
FIG. 6 is a sectional view of a third embodiment having an insert and single composite layers on both the inner and outer surfaces of the insert.
Figure 7:
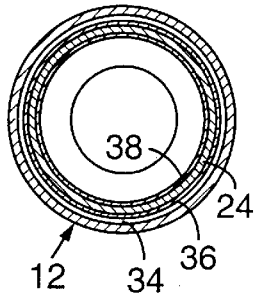
FIG. 7 is a sectional view taken along line 7—7 of FIG. 6.

In a further embodiment, as shown in FIGS. 6 and 7, a first composite layer 36 having its greatest strength in a substantially circumferential direction is bonded to the outer surface of insert 18 and a second composite layer 38 having its greatest strength in a substantially circumferential direction is bonded to the inner surface of insert 18. This embodiment provides maximum effectiveness and durability in comparison to the above-described embodiments, but with a trade off of increased manufacturing cost.

The present invention, with its insert-supported barrel and composite-reinforced insert provides several advantages. A conventional multi-wall bat having an aluminum insert exhibits excellent impact response but, due to its relatively thin outer wall, may be prone to denting and have a relatively short useful life. A conventional multi-layer composite insert supported within an aluminum tubular bat helps prevent permanent deformation and optimizes durability but may reduce desirable elastic deflection in the bat due to the high modulus of elasticity of the composite material. The present invention, however, overcomes these shortcomings by combining the elasticity and isotropic shear strength of the tubular sleeve (at the center of this load bearing member) with the circumferential strength of a thin composite material (at the outer surface of the load bearing member) to produce a bat with improved durability and little or no reduction in performance.

The present invention provides greater resistance to localized plastic deformation of the impact portion because the thin composite material gives the impact portion greater strength in the circumferential direction. Yet, the composite material does not significantly restrict elastic deflection in the longitudinal direction, allowing the insert to retain its leaf-spring capacity to transfer energy back to the ball as it leaves the surface of the bat. Moreover, because the composite material adds a significant amount of strength to the bat, thinner aluminum may be used for the tubular frame 11 and insert 18. Thus, the present invention can be made lighter than prior multi-wall aluminum bats.

Efficient use of high-cost composite material also allows for the maximization of the benefits provided by composite materials with minimal cost. Since only a thin composite material is needed (one to three layers, for example), material costs for the present invention are reduced. Furthermore, the present invention is easier and less expensive to manufacture than a self-supporting insert made entirely of composite layers. In addition, the present invention is seemingly unaffected by inter-laminar shear forces due to the fact that the composite material is located away from the neutral axis (where inter-laminar shear stresses are highest) of the insert (or other metal carrier).

Figure 8:
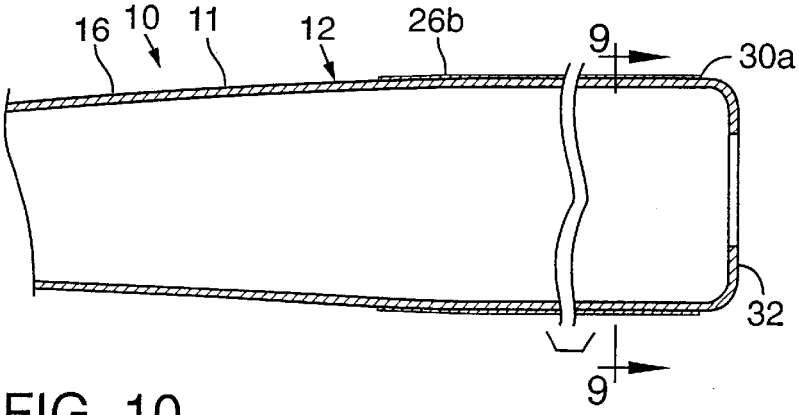
FIG. 8 is a sectional view of a fourth embodiment having a single composite layer on the outer surface of the bat's impact portion.
Figure 9:
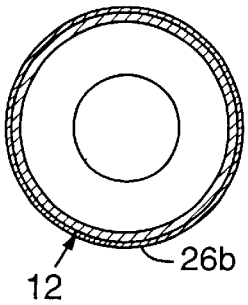
FIG. 9 is a sectional view taken along line 9—9 of FIG. 8.

While the above discussed embodiments describe the invention in the context of a multi-wall bat (with an insert/exert for example) to provide maximum "spring" to the impact portion of the bat, this invention's utility also has been demonstrated in the context of single-wall tubular bats. In one such embodiment, shown in FIGS. 8 and 9, a composite layer 26*b* having its greatest strength in a substantially circumferential direction may be bonded to at least a portion of the outer surface of the impact portion 12 of a single-wall tubular bat 10 in the manner previously described. Preferably, the composite layer 26 includes fibers oriented at about 80 to 90 degrees relative to the axis of the bat. The composite layer 26 preferably has a thickness less than about 0.015 inch, more preferably, about 0.003 to 0.015 inch, and most preferably about 0.0055 inch. A powder coating may be applied to the composite layer 26 in a conventional manner to provide a suitable surface on which graphics can be placed. This particular embodiment is a lower cost alternative to the embodiments of FIGS. 1 through 7. This embodiment not only improves the durability of conventional single-wall bats but allows the wall thickness of the impact portion to be reduced an amount sufficient to noticeably improve the impact response of a conventional single-wall bat.

In one illustrated example of this embodiment, the tubular frame has a yield strength of 85,000 psi and an impact portion that is 12 inches long and has a wall thickness of 0.067 inch. The composite layer 26*b* is about 8.5 inches long and 0.003 inch thick and is positioned on the outer surface of the impact portion 12 such that second end 30*a* is 0.75 inch from the head portion 32.

Figure 10:
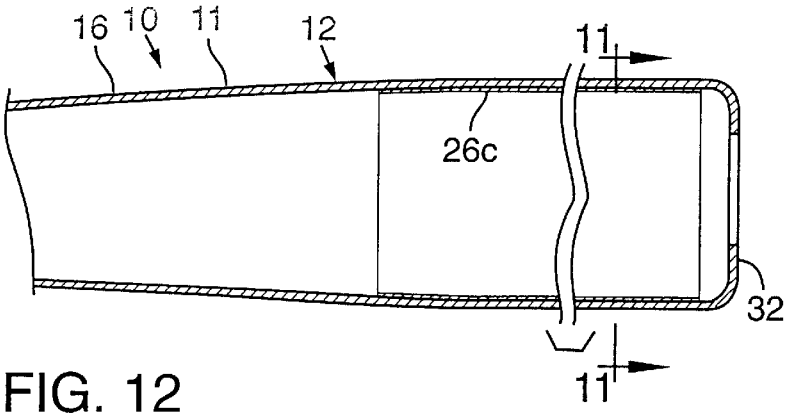
FIG. 10 is a sectional view of a fifth embodiment having a single composite layer on the inner surface of the bat's impact portion.
Figure 11:
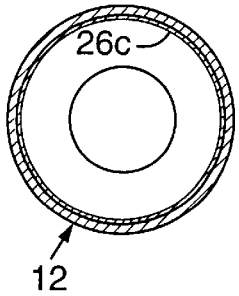
FIG. 11 is a sectional view taken along line 11—11 of FIG. 10.
Figure 12:
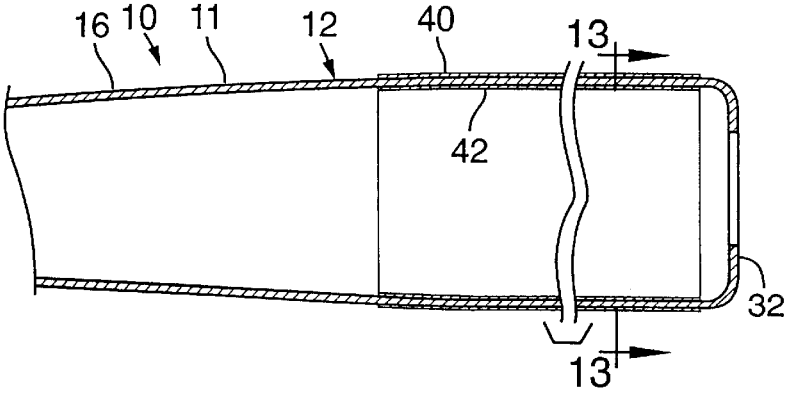
FIG. 12 is a sectional view of a sixth embodiment having single composite layers on both the inner and outer surfaces of the bat's impact portion.
Figure 13:
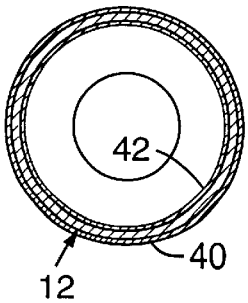
FIG. 13 is a sectional view taken along line 13—13 of FIG. 12.

Other examples of single-wall tubular bats embodying the present invention are shown in FIGS. 10–13. FIGS. 10 and 11 show a composite layer 26*c* having its greatest strength in a substantially circumferential direction bonded to the inner surface of the impact portion 12 of a tubular bat 10. Alternatively, as shown in FIGS. 12 and 13, a first composite layer 40 having its greatest strength in a substantially circumferential direction is bonded to the outer surface of the impact portion 12 and a second composite layer 42 having its greatest strength in a substantially circumferential direction is bonded to the inner surface of the impact portion 12. It will of course be appreciated that more than one layer of composite material can be bonded to the inner and/or outer surface of a single-wall bat. The preferred total thickness of the composite material on each surface, regardless of the number of layers, is less than about 0.015 inch, preferably about 0.003 to 0.015 inch and, most preferably, about 0.0055 inch (again depending on the particular application).

Though relatively thin, the composite material improves the durability of a single-wall bat. Even more remarkably, the composite material allows the bat manufacturer to reduce the wall thickness of the barrel and thereby noticeably improve the bat's impact response.

The present invention also contemplates the use of multiple composite layers banded on the impact portion and/or the insert of a bat. Banding involves the application of composite layers of varying lengths, thicknesses and fiber orientations on a surface portion of the impact portion or insert which is subject to deflection upon impact. This design exploits the directional strength of composite materials and allows the manufacturer to selectively add strength and stiffness where it is needed and in the direction that it is needed. Because the intended use of a bat often drives its design, the various attributes of the composite layers, such as length, thickness, location on a bat, or orientation of fibers, may be manipulated to suit a particular application. For example, the optimization of the composite materials in a tubular bat will vary according to different factors such as whether the bat is used for softball or baseball, whether the game involves fast pitch or slow pitch, or the experience level or style of play of a particular player. The present invention allows the manufacturer to "fine tune" the bat to give it localized strength characteristics to suit the particular application. The foregoing "banding" constructions achieve an effect much like "side-wall ironing" (a known metal working technique), but allows even greater flexibility and ease of manufacture.

Figure 14:
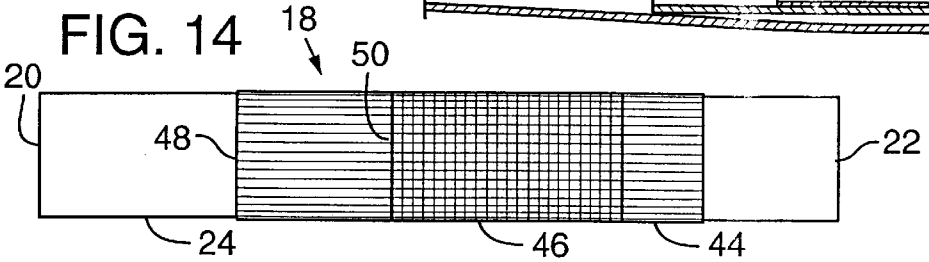
FIG. 14 is an enlarged view of an alternate insert embodiment having two composite layers bonded to an outer surface of the insert.

By way of example, a particular insert design which has been found to exhibit excellent durability and performance characteristics for hitting a softball is illustrated in FIG. 14. In this embodiment, an insert 18 for use in a tubular bat, has two composite layers. A first composite layer 44 having its fibers oriented substantially at 0 degrees relative to the axis of the bat is bonded to the tubular sleeve 24 in the manner previously described. A shorter second composite layer 46 having its fibers oriented substantially at 90 degrees relative to the axis of the bat is bonded on top of the first composite layer 44. The first composite layer 44 covers a substantial portion of the outer surface of the tubular sleeve while the shorter, second composite layer 46, which is positioned near the center of the insert 18, covers only the portion of the insert 18 where most impacts are likely to occur. As one illustrated embodiment, the first composite layer 44 is about 8.5 inches long and about 0.003 inch thick and is positioned on the tubular sleeve 24 such that the first end 48 is about 4.00 inches from the first end 20 of the insert 18. The second composite layer 46 is preferably about 4 inches long and about 0.0055 inch thick and is positioned on the top of the first composite layer 44 such that the first end 50 of the second composite layer 46 is about 7.25 inches from the first end 20 of the insert 18.

The thickness of the insert 18 therefore is greatest near the center where there are two concentric layers of composite material and decreases (incrementally) towards the first and second ends of the insert (which are not covered by any composite material). Such an embodiment is advantageous because it provides the greatest thickness and strength in the area where most impacts occur, and less thickness and less weight (and hence greater flexibility) in the area where the stress is less. This design therefore behaves much like a tapered beam. As a result, less material is needed for the tubular sleeve 24 and impact portion 12. Further, by using a shortened second composite layer 46, no more high cost composite material is used than is actually needed.

In yet another embodiment (not shown), the insert 18 of FIG. 14 may be modified so as to bond the longer composite layer (fibers at substantially 0 degree orientation) to the inner surface of the insert and bond the shorter composite layer (fibers at substantially 90 degree orientation) thereon. Alternatively, the first composite layer and the shorter second composite layer may be bonded separately to the outer and inner surfaces, respectively, of the tubular sleeve or vice versa, much like the embodiment of FIGS. 6 and 7.

As another alternative, the second composite layer can be segmented by bonding two or more spaced bands of composite material to the first composite layer or to the insert surface opposite the surface to which the first composite layer is bonded.

Figure 15:
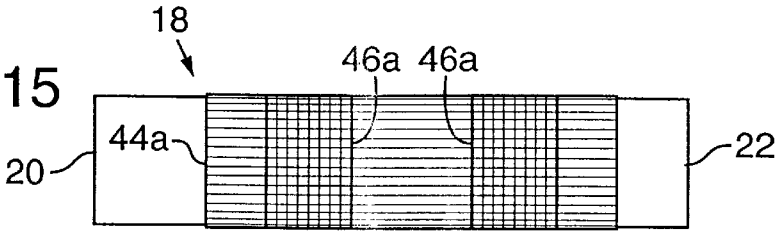
FIG. 15 is an enlarged view of another alternate insert embodiment having two composite layers, one of which is divided into separate discrete bands, bonded to an outer surface of the insert.

It will be appreciated that many of the features and principles described above can be combined to create bat designs better suited for different applications or at least to provide alternative design approaches. For example, FIG. 15 illustrates that the insert embodiment of FIG. 14 can be modified to provide a second composite layer 46*a* (overlying first layer 44*a*) having separate bands of composite material. In this way, the bat's impact portion is given additional strength and stiffness in select local locations and directions to fine tune the bat's impact response behavior. Though not shown, the second layer could be provided with three or more bands of composite material; the first and second layers could be bonded to the inner surface of the insert; and a third layer of composite material with the same or different reinforcing characteristics could be bonded to the second layer. These principles also can be applied where the insert is mounted in overlying relationship to the impact portion.

Figure 16:
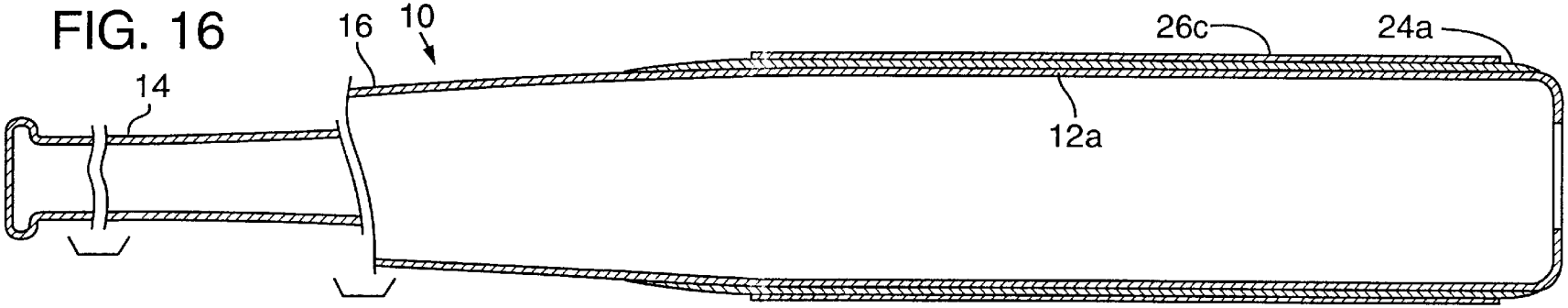
FIG. 16 is a sectional view of a seventh embodiment of the present invention.
Figure 17:
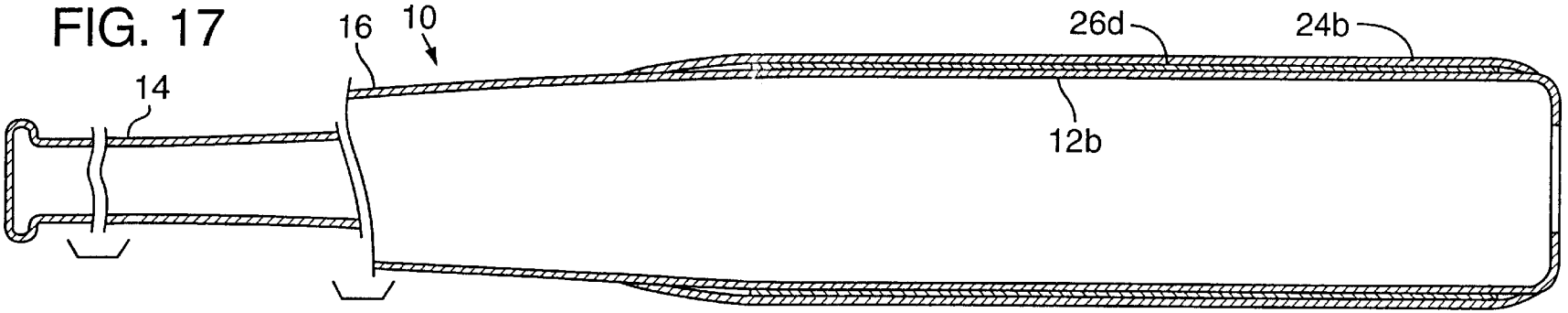
FIG. 17 is a sectional view of an eighth embodiment of the presentation.

By way of further example, FIGS. 16 and 17 illustrate the embodiment of the present invention in the context of an insert mounted external co-axial relationship to the impact portion 12*a* (FIG. 16), 12*b* (FIG. 17). In the FIG. 16 embodiment, the insert 24*a* is mounted on the outer surface of the bat in proximate co-axial relationship with the impact portion 12*a*, and composite member 26*c* is bonded to at least a portion of the outer surface of the insert. The interface between the insert and impact portion can be defined by a gap or no gap. Again, however, the insert preferably is not bonded to the impact portion or secured by interference fit.

The FIG. 17 embodiment is similar to the FIG. 16 embodiment except that the composite member 26*d* is bonded to either the inner surface of the insert 24*b* or outer surface of the impact portion 12*b*.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

We claim:

1. A multi-wall bat comprising:

a metal substantially tubular body having a handle portion and an impact portion, the impact portion having an internal surface facing inwardly toward a center axis of the body;

a generally tubular metal insert located coaxially within the tubular body, the insert having a first length measured in a direction substantially parallel to the axis, and an outer surface, the insert being retained adjacent to the impact portion, and at least a portion of the insert capable of moving substantially independently relative to the impact portion during bat-ball contact; and a composite member disposed between the internal surface of the body and the outer surface of the insert, the composite member having a second length measured in a direction substantially parallel to the axis, the first length being greater than the second length.

2. A bat according to claim 1 wherein the outer surface of the insert and internal surface of the impact portion are disposed relative to one another such that minimal shear loads can be transferred from one of the insert and impact portion to the other.

3. A bat according to claim 1 wherein a space is defined between the outer surface of the insert and internal surface of the impact portion, the space effectively defining at least a zero clearance, whereby the insert can be inserted into the tubular body without use of significant force.

4. A bat according to claim 1 wherein the composite member has greater strength in the circumferential direction than axial direction.

5. A bat according to claim 4 wherein the composite member contains fibers oriented substantially at ninety degrees relative a longitudinal axis of the insert.

6. A bat according to claim 1 wherein the composite member includes at least one layer bonded to at least a portion of the outer surface.

7. A bat according to claim 1 wherein the composite member includes at least one layer bonded to at least a portion of the internal surface of the impact portion.

8. A bat according to claim 1 wherein the composite member has a thickness of about 0.003 to 0.015 inch.

9. A bat according to claim 1 wherein the composite member includes at least one first layer bonded to the internal surface and at least one second layer bonded to the external surface.

10. A bat according to claim 7 wherein each layer has greater strength in the circumferential direction than the axial direction.

11. A bat according to claim 10 wherein each layer contains fibers oriented substantially at a ninety degree angle relative to the center axis.

12. A bat according to claim 11 wherein each layer has a thickness of about 0.003 to 0.015 inch.

13. The bat of claim 1 wherein the composite member is a substantially tubular and is bonded to one of the outer surface of the insert and the internal surface of the body.

14. The bat of claim 1 wherein the body includes an intermediate tapering portion and an end portion, and wherein the insert engages at least one of the intermediate tapering portion and the end portion.

15. The bat of claim 1 wherein the second length is approximately 60% of the first length.

16. The bat of claim 1 wherein the first length is within the range of 8–20 inches and wherein the second length is within the range of 3 to 16 inches.

17. The bat of claim 1 wherein the insert includes a distal end and a proximal end, wherein the composite member includes a distal and proximal end, and wherein the distal end of the insert is spaced apart from the distal end of the composite member.

18. The bat of claim 1 wherein the insert includes a distal end and a proximal end, wherein the composite member includes a distal and proximal end, and wherein the proximal end of the insert is spaced apart from the proximal end of the composite member.

19. The bat of claim 17 wherein the proximal end of the insert is spaced apart from the proximal end of the composite member.

20. A bat comprising:

a handle portion;

a substantially tubular impact portion;

a tapered transition portion interconnecting the handle portion and impact portion; and a composite member supported by a substantially tubular metal carrier, the composite member having fibers oriented to give the metal carrier greater strength in a circumferential direction, the composite member being formed of at least one layer of composite material and having a total thickness less than about 0.015 inch, the composite member being supported in proximate coaxial relationship to the impact portion, the metal carrier having a first longitudinal dimension and the composite member having a second longitudinal dimension, the first longitudinal dimension being greater than the second longitudinal dimension;

wherein the metal carrier is a substantially tubular support member separate from the impact portion, the support member being in coaxial proximate relationship to the impact portion so as to reinforce the impact portion during ball impact.

21. The bat of claim 20 wherein metal carrier engages at least portion of at least one of the tapered transition portion and the impact portion.

22. The bat of claim 20 wherein the second dimension is approximately 60% of the first dimension.

23. The bat of claim 20 wherein the first dimension is within the range of 8–20 inches and wherein the second dimension is within the range of 3 to 16 inches.

24. A multi-wall bat for impacting a ball, the bat comprising:

a first generally tubular member extending along a longitudinal axis, the first member having a handle portion, an intermediate tapered portion and a barrel portion;

a second generally tubular member positioned coaxially with the first member, the second member being retained adjacent to the barrel portion and at least a portion of the second member being capable of moving substantially independently relative to the barrel portion during contact with the ball, the second member having a first length measured in a direction substantially parallel to the axis; and a composite member disposed between the first and second members, the composite member having a second length measured in a direction substantially parallel to the axis, the first length being greater than the second length.

25. The bat of claim 24, wherein the first member comprises a metal.

26. The bat of claim 24, wherein the second member comprises a metal.

27. The bat of claim 24 wherein the composite member is connected to at least a portion of one of the first and second members.

28. The bat of claim 24 wherein the second member is an insert.

29. The bat of claim 24 wherein the second member is an outer sleeve.

30. The bat of claim 24 wherein the second member engages at least one of the intermediate tapered portion and the barrel portion.

31. The bat of claim 24 wherein the second length is approximately 60% of the first length.

32. The bat of claim 24 wherein the first length is within the range of 8–20 inches and wherein the second length is within the range of 3 to 16 inches.

33. The bat of claim 24 wherein the second member includes a distal end and a proximal end, wherein the composite member includes a distal and proximal end, and wherein the distal end of the second member is spaced apart from the distal end of the composite member.

34. The bat of claim 24 wherein the second member includes a distal end and a proximal end, wherein the composite member includes a distal and proximal end, and wherein the proximal end of the second member is spaced apart from the proximal end of the composite member.

35. The bat of claim 33 wherein the proximal end of the second member is spaced apart from the proximal end of the composite member.

* * * * *